US005279005A

United States Patent [19]

Valley

[11] Patent Number: 5,279,005

[45] Date of Patent: Jan. 18, 1994

[54] TUB SPOUT

[75] Inventor: Harold J. Valley, Irvine, Calif.

[73] Assignee: Modern Faucet Mfg. Co., Los Angeles, Calif.

[21] Appl. No.: 59,873

[22] Filed: May 10, 1993

Related U.S. Application Data

[63] Continuation of Ser. No. 694,007, Apr. 30, 1991, abandoned.

[51] Int. Cl.[5] ..... E03C 1/042; A47K 3/20

[52] U.S. Cl. ..... 4/567; 4/695; 137/467

[58] Field of Search ..... 4/191, 192, 194, 567, 4/675, 676, 677, 678, 695; 137/467; 251/175

[56] References Cited

U.S. PATENT DOCUMENTS

| | | | |
|---|---|---|---|
| Re. 27,819 | 11/1973 | Moen | 4/191 |
| 3,012,251 | 12/1961 | Fife | 4/192 |
| 3,471,872 | 10/1969 | Symmons | 4/191 |
| 3,473,558 | 10/1969 | Mongerson | 4/191 X |
| 3,576,197 | 4/1971 | Bastian | 137/467 X |
| 3,906,990 | 9/1975 | Nelson | 137/467 X |
| 3,913,605 | 10/1975 | Ward | 137/467 X |
| 4,116,210 | 9/1978 | Nelson | 137/467 X |
| 4,117,858 | 10/1978 | Bucknell et al. | 137/467 X |
| 4,606,370 | 8/1986 | Geipel et al. | 137/467 X |

*Primary Examiner*—William A. Cuchlinski, Jr.
*Assistant Examiner*—John L. Beres
*Attorney, Agent, or Firm*—Lackenbach Siegel Marzullo Aronson & Greenspan

[57] ABSTRACT

A tub spout which receives water from a water source via a source pipe is capable of diverting water received from the source pipe and includes a hollow spout having an outlet and an inlet, a rear cap removably assembled at the inlet has a rear aperture for allowing water from the source pipe to enter the hollow spout, valve means are removably disposed in the hollow spout for blocking water flow from the rear aperture to the outlet, and control means are connected to the valve means for regulating the valve means for controlling water flow through the hollow spout.

20 Claims, 7 Drawing Sheets

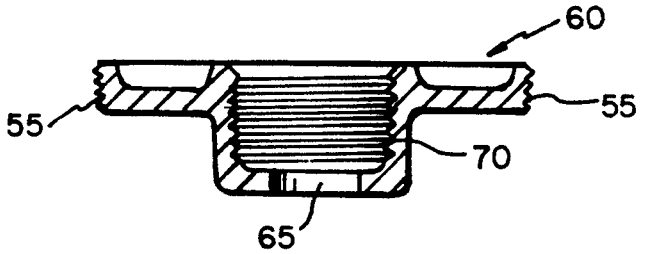
FIG. 3a
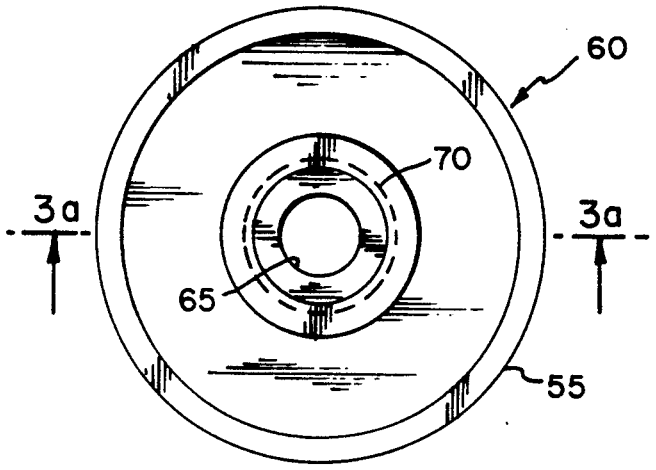
FIG. 3b
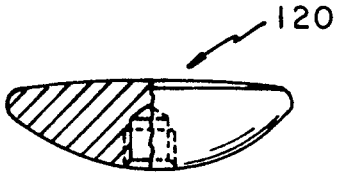
FIG. 9
FIG. 8
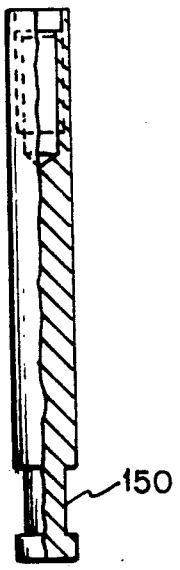
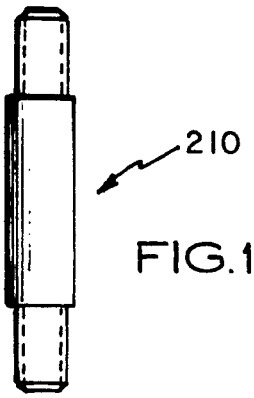
FIG. 10

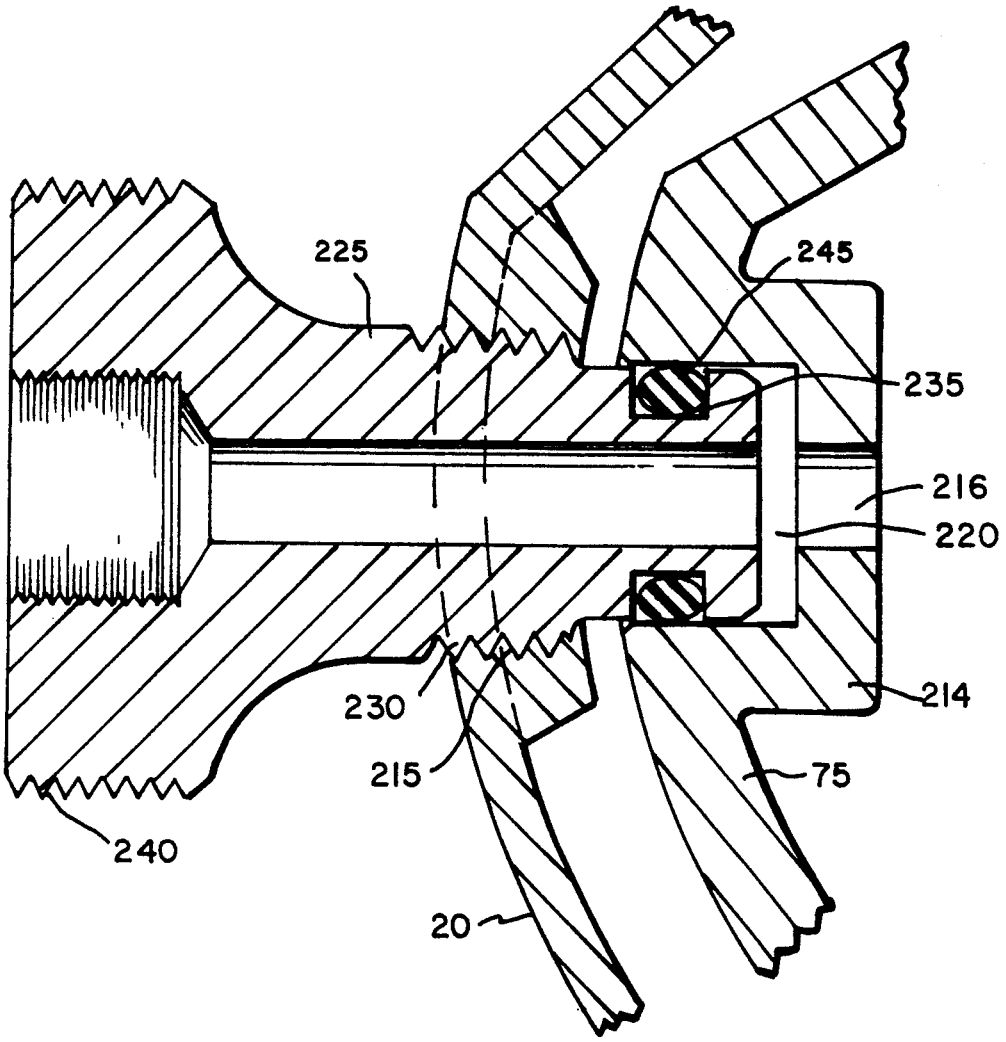
FIG. 14
FIG. 13
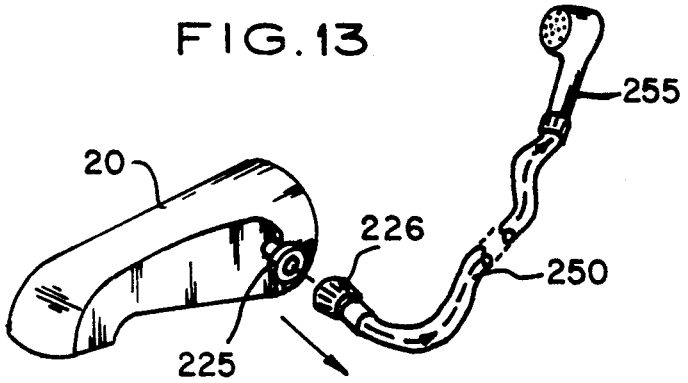

TUB SPOUT

This application is a continuation, of application Ser. No. 07/694,007, filed apr. 30, 1991, now abandoned.

TECHNICAL FIELD

The present invention relates generally to tub spouts and, more particularly, to such a tub spout which is capable of diverting water flow and has a replaceable diverting mechanism therein.

BACKGROUND OF THE INVENTION

Tub spouts which are capable of blocking water from flowing therethrough and, instead, diverting the flow to another location, such as a shower, are generally known. Such a transfer of water flow is conventionally accomplished with a flapper/gate which is pushed and held against a seat by water pressure. The seat is included as part of a partition disposed in the spout. Additionally, the partition forms a chamber with a section of the spout and a rear cap which is attached to one end of the spout. The rear cap includes an aperture extending therethrough which has internal threads compatible with the external threads of a source pipe.

Further, a stem has one end attached to the flapper/-gate, and the other end extending externally from the spout. Thus, the flapper/gate can be controlled using the stem. More specifically, when the stem is pulled upwards so as to align the flapper/gate with the seat, water pressure from water entering the chamber pushes against the flapper/gate so as to create a seal with the seat and not allow water to flow through the spout. When the stem is not pulled upwards, the flapper/gate does not align with the seat, and water entering the spout flows through the chamber and through the partition aperture and exits at the other end of the spout.

Disadvantageously, the rear cap, partition and flapper/gate are all made of brass and soldered in the spout. Thus, once assembled, it is impossible and/or impractical to disassemble or replace a failed flapper/gate valve.

SUMMARY OF THE INVENTION

Generally, the present invention relates to a tub spout which receives water from a water source via a source pipe having an external threaded segment, and is capable of diverting the water. The tub spout includes a hollow spout having an inlet and an outlet. A rear cap is removably assembled at the inlet, and the rear cap includes a rear aperture which allows water from the source pipe to enter the hollow spout. A valve body is insertable into the hollow spout through the inlet and removable from the hollow spout also through the inlet. The valve body includes a flange which aligns with and seats on a ledge and bosses disposed within and integral with the hollow spout. The valve body further includes walls connected to the flange which extend toward the outlet of the hollow spout. A partition is integral with the walls, and forms a chamber with the walls and the rear cap. The partition includes a partition aperture for allowing water to flow from the chamber to the outlet of the hollow spout.

Further, a valve having a seal is alignable with the partition aperture for sealing the partition aperture when diverting of water is desired. The seal has a shape which utilizes water pressure to create a positive seal.

Additionally, a longitudinally movable stem is connected to the valve for controlling alignment and misalignment of the seal with the partition aperture.

In an alternative embodiment, a hose with a shower head can be connected to the hollow spout, and water flow can be diverted therethrough.

It is, therefore, a principal object of the present invention to provide an improved tub spout which overcomes all of the disadvantages of the prior art tub spouts.

Another object of the invention is to provide a tub spout which has a rear cap which is removable.

A further object of the invention is to provide a tub spout having a valve mechanism which is removable and replaceable.

Yet another object of the invention is to provide a tub spout which utilizes water pressure to create a positive seal when diverting water.

Still a further object of the present invention is to provide a tub spout capable of having a hose with a shower head connected thereto and diverting water through the hose and shower head.

Other objects, features and advantages of the present invention will become apparent with the following detailed description taken together with the accompanying drawings.

BRIEF DESCRIPTION OF THE DRAWINGS

For a fuller understanding of the invention, reference is had to the following description taken in connection with the accompanying drawings, in which:

FIG. 2(*b*) is a view taken from one end of the hollow spout of FIG. 2(*a*).

FIG. 3(*a*) and (*b*) are views of a rear cap in accordance with the present invention.

FIG. 8 is a partial cross-sectional view of n elongated stem in accordance with the present invention.

FIG. 9 is a partial cross-sectional view of a knob in accordance with the present invention.

FIG. 10 is an extension for the elongated stem in accordance with the present invention.

FIG. 13 is a perspective view of an alternative embodiment of the present invention.

FIG. 14 is an enlarged cross-sectional view of a portion of the hollow spout and valve body according to the alternative embodiment.

DETAILED DESCRIPTION OF THE PREFERRED EMBODIMENTS

Figure 1:
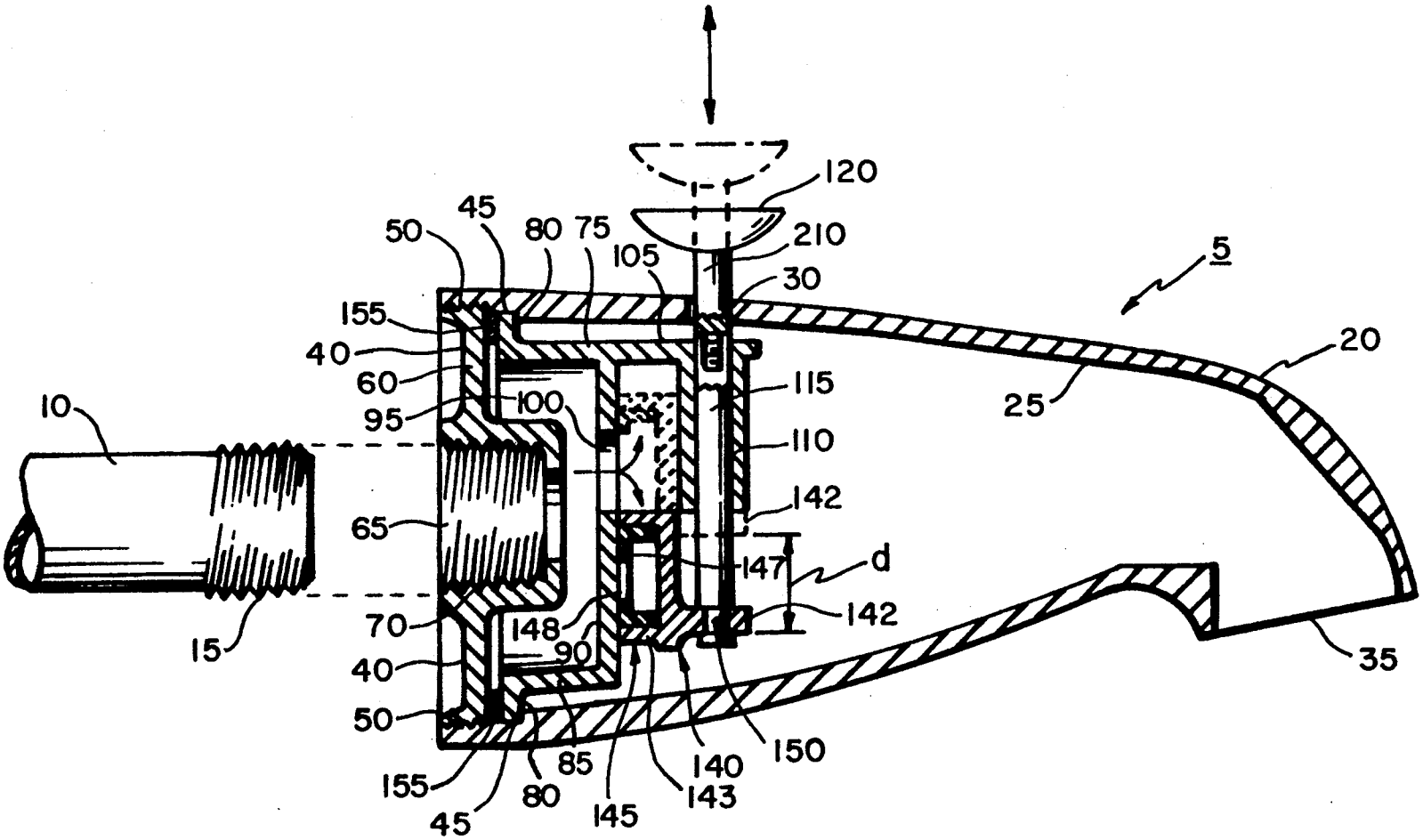
FIG. 1 is a cross-sectional view of an assembled tub spout in accordance with the present invention.
Figure 2A:
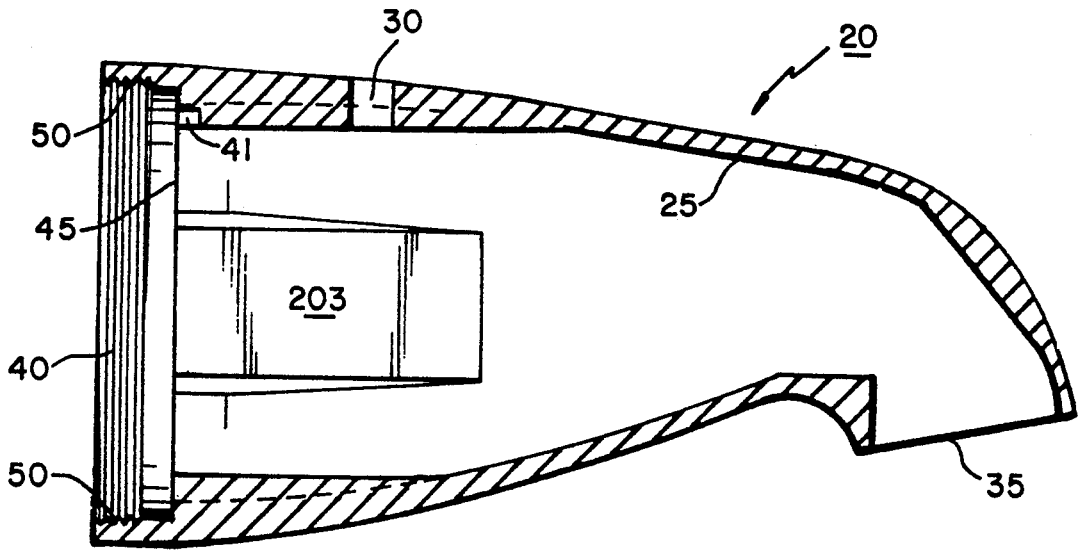
FIG. 2(*a*) is a cross-sectional view of a hollow spout of the present invention.
Figure 2B:
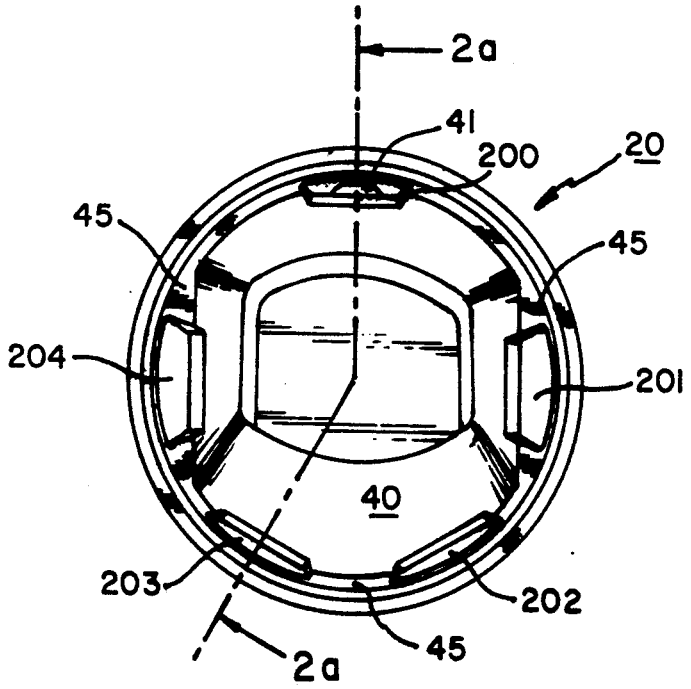
Figure 4:
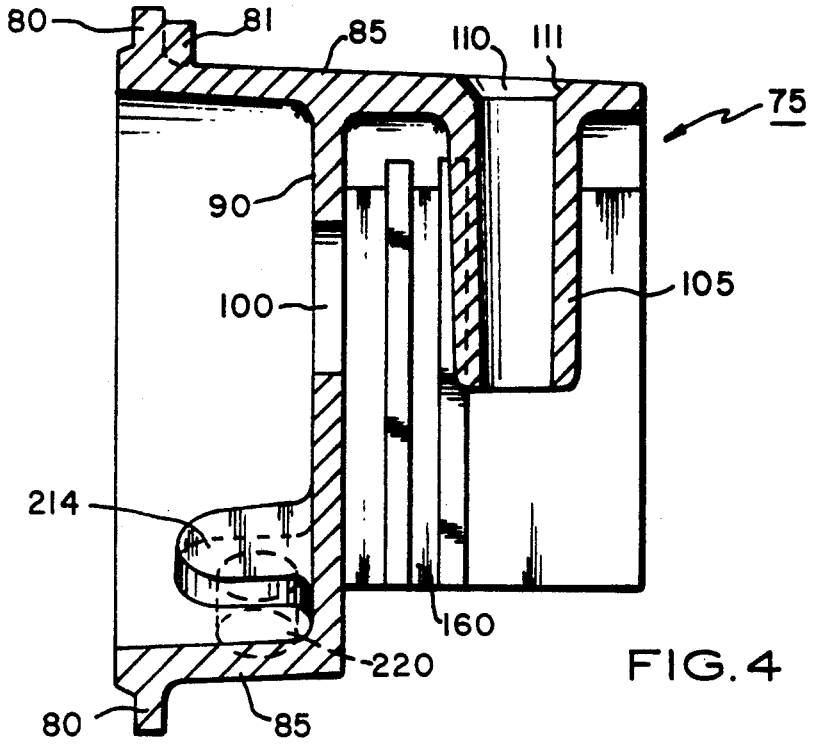
FIG. 4 is a cross-sectional view of the valve body in accordance with the present invention.

Referring initially to FIG. 1, an assembled tub spout in accordance with the present invention is shown in cross-section and designated generally by the numeral 5. The tub spout 5 receives water from a water source (not shown), such as a city or town water supply, via a source pipe 10 which has an external threaded segment 15 disposed thereon. The tub spout 5 includes a hollow spout 20 which is also shown in FIGS. 2(*a*) and 2(*b*). The hollow spout 20 has, for example, an elongated shape and includes an inner side 25, a spout aperture 30, an outlet or outlet end 35, an inlet or inlet end 40, a keyway 41, a plurality of "built-up" areas or bosses 200–204 which provide support ribs, and a ledge 45. Preferably, the inlet end 40 is circular and has an internal threaded segment 50 which is disposed on the inner side 25 of the hollow spout 20 proximate the inlet end 40. The ledge 45 is disposed peripherally on the inner side 25 of the hollow spout 20 adjacent the internal threaded segment 50, and is substantially normal to and extends towards the longitudinal axis of the hollow spout 20. Further, there are, for example, five bosses 200–204 each formed by adding thickness to appropriate positions on the inner side 25 of the hollow spout 20.

A rear cap 60, also shown in FIGS. 3(*a*) and (*b*) has external threads 55 disposed about its outer circumference which are of a thread size compatible of threadedly engaging the internal threaded segment 50 of the hollow spout 20. Thus, the rear cap 60 can be assembled with or disassembled from the hollow spout 20 by turning the rear cap 60 either in a clockwise or counterclockwise direction so as to engage or disengage the external threads 55 of the rear cap 60 and the internal threaded segment 50 of the hollow spout 20. However, a skilled artisan will appreciate that the rear cap 60 can be engaged with the inlet end 40 of the hollowing spout 20 by any suitable means which allows the rear cap 60 to be assembled with and disassembled from the hollow spout 20 as desired.

Further, the rear cap 60 has a rear aperture 65 which extends therethrough. The rear aperture 65 is, for instance, centrally located relative to the central axis of the inlet end 40 of the rear cap 60, and has internal threads 70 which are of a thread size compatible for threadedly engaging the external threaded segment 15 of the source pipe 10 so that, when assembled, water from the source pipe 10 can enter the hollow spout 20 through the rear aperture 65.

A valve body 75, also shown in cross-section in FIGS. 4–7, comprises, for example, a plastic material for ease of construction, is assembled or inserted into the hollow spout 20 prior to assembly of the rear cap 60. The valve body 75 is insertable into the hollow spout 20 through the inlet end 40 and removable from the hollow spout also through the inlet end 40.

The valve body 75 includes a flange 80 and a key 81. The flange 80 aligns with and seats simultaneously on the ledge 45 and bosses 200–204; and the key 81 corresponds to and inserts into the keyway 41 so that the valve body 75 can easily be properly oriented within the hollow spout 20 and remain in such proper orientation therein.

Walls 85 are integrally connected to the flange 80. When the valve body 75 is assembled in the hollow spout 20, the walls 85 extend toward the outlet end 35 of the hollow spout 20. A partition 90 is integral with the walls 85 and, as shown in FIG. 1, forms a void or chamber 95 with the walls 85 and the rear cap 60. The partition 90 includes a partition aperture 100 which allows water entering the rear aperture 65 to flow from the chamber 95 through the hollow spout 20 to the outlet end 35. The partition aperture 100 need not be centrally aligned with the aperture 65 of the rear cap 60, as shown in FIG. 1. However, such misalignment is not required for the tub spout 5 to function properly.

A seal 155, such as a rubber washer or gasket, is located between the flange 80 and the rear cap 60. When assembled, the rear cap 60 is sealed with the flange 80 in a water-tight manner due to the seal 155. Thus, water cannot exit the chamber 95 between the rear cap 60 and flange 80. The valve body 75 further includes a guide section 105 having a guide aperture 110 which includes a chamber 111 at one end. When assembled, the guide aperture 110 substantially aligns with the spout aperture 30, as shown in FIG. 1.

Figure 5:
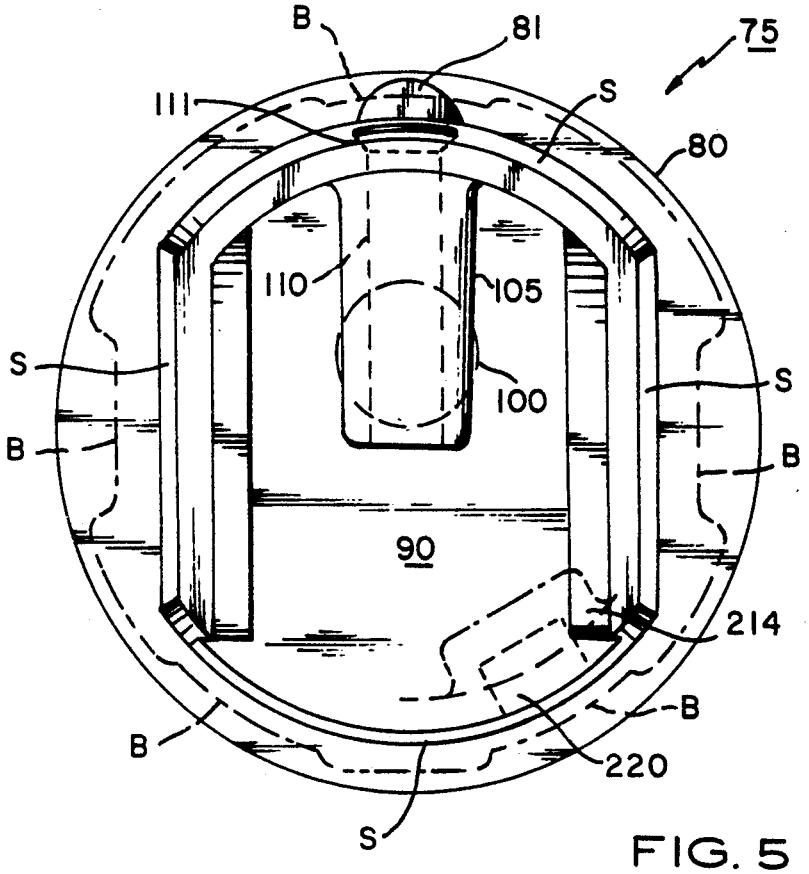
FIG. 5 is one end view of the valve body in accordance with the present invention.
Figure 6:
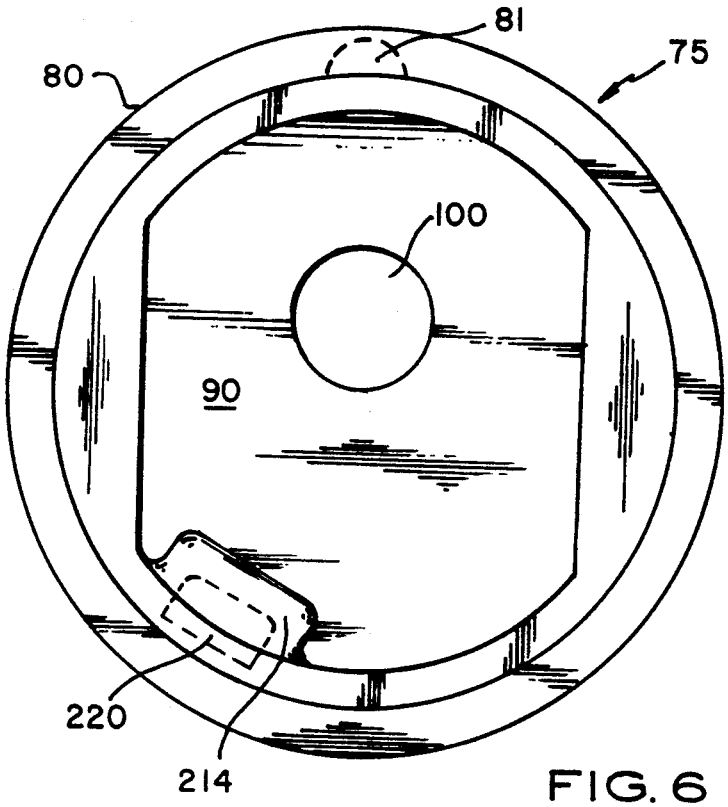
FIG. 6 is another end view of the valve body in accordance with the present invention.
Figure 7:
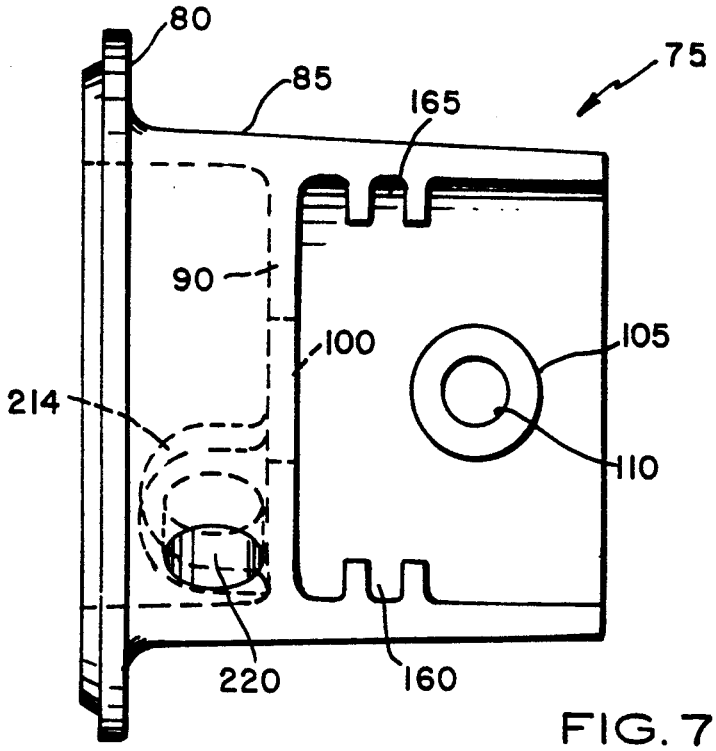
FIG. 7 is a bottom view of the valve body in accordance with the present invention.

The flange 80 is generally circular in shape and is of a diameter to align with and seat on the ledge 45 and bosses 200–204.. When the tub spout 5 is assembled, the seal 155 and flange 80 are held in place and fitted between the ledge 45 and bosses 200–204, and the rear cap 60. Further, the valve body 75 includes a pair of elongated track-like slits or grooves 160, 165 which will be discussed in more detail hereinafter. If desired, the valve body 70 may taper or slant outwardly toward the partition 90 as indicated in FIG. 5 by the "S" so as to substantially conform to the taper of the hollow spout 20. Additionally, FIG. 5 shows in phantom outline "B" the positions where the bosses 200–204 and ledge 45 of the hollow spout 20 are located relative to the valve body 75 when assembled in the hollow spout 20.

An elongated stem 115, also shown in FIG. 8, is inserted through and guided by the guide aperture 110 of the guide section 105, and further guided by the spout aperture 30. As best shown in FIG. 1, the elongated stem 115 has one end which extends beyond the spout aperture 30 and a another end which extends below the guide aperture 110 within the hollow spout 20. Thus, as assembled, longitudinal movement of the elongated stem 115 can be controlled from outside the hollow spout 20. In this connection, a knob 120, also shown in FIG. 9, can be attached by any suitable means to the elongated stem 115 for operating and control convenience. Further, the elongated stem 115 has a peripherally defined indented portion 150 thereon.

An extension, shown in FIG. 10, may be connected between the elongated stem 115 and the knob 120. The extension 210 will add to the length of the elongated stem 115 as required and will assist in assembly of the tub spout 5. Insofar as assembly of the tub spout 5 is concerned, elongated stem 115 can be of a length which will fit into the hollow spout 20 through the inlet end 50 when the elongated stem 115 is pre-assembled in the guide aperture 110 before insertion of the valve body 75 into the hollow spout 20. The extension 210 can then be inserted through the spout aperture 30 to connect with the elongated stem 115. The extension 210 can be connected to the elongated stem 115 and the knob 120 by any suitable means, for example, by threaded engagement. Note that the chamfer III of the guide aperture 110 allows the extension 210 to be easily inserted therein for assembly.

Figure 11B:
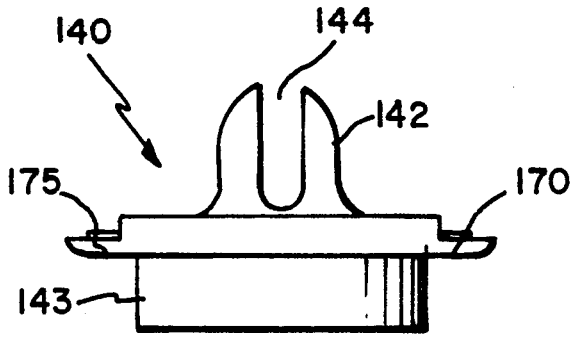
FIG. 11(*a*)–(*c*) are various views of a valve in accordance with the present invention.
Figure 11C:
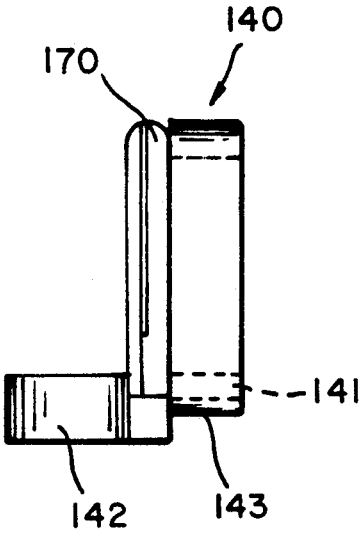
Figure 11A:
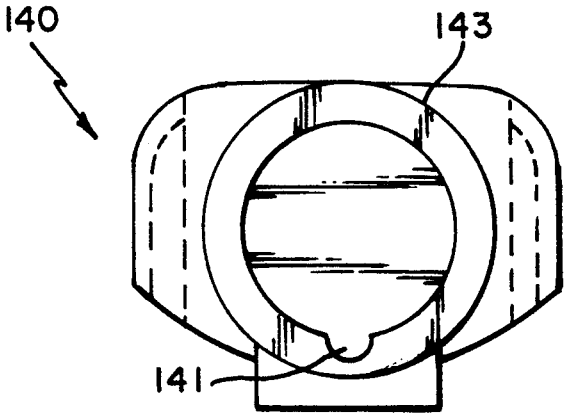

A valve 140, as shown in FIGS. 11(*a*)–(*c*), includes a connecting portion 142 which engages with the elongated stem 115. The valve 140 may have indented side portions 170, 175 which are inserted into the elongated track-like slits or grooves 160, 165 of the valve body 75 to aid in guiding and movement of the valve 140 within the slits or grooves 160, 165. The valve 140 further includes a water release groove 141, and a sealing portion 143 into which a seal 145 fits. The seal 145 is capable of sealing the partition aperture 100 when aligned therewith.

The seal 145 preferably comprises rubber and has a shape so that pressure of water creates a positive seal to block water from flowing through the hollow spout 20 to the outlet end 35. The shape of the seal 145 will be discussed in greater detail hereinbelow.

The valve 140 engages with the elongated stem 110 so that alignment of the seal 145 with the partition aperture 100 can be controlled by longitudinal movement of the elongated stem 115. In other words, when the elongated stem 115 is in a raised or divert position, the seal 145 is aligned with the partition aperture 100; and when the elongated stem 100 is in a lowered or non-divert position, the seal 145 is not aligned with the partition aperture 100. FIG. 1 shows in phantom the elongated stem 115 in the divert position so as to position the seal 145 to align with the partition aperture 100. The distance "d" represents the distance between the non-divert and divert positions. Note that the elongated track-like slits or grooves 160, 165 maintains the valve 140 in position adjacent to the partition 90 whether the valve 140 is in a raised position or lowered position. Additionally, when the elongated stem 115 is in the raised or divert position, the connecting portion 142 of the valve 140 contacts the lower portion of the guide aperture 110 simultaneously with the seal 145 aligning with the partition aperture 100. Thus, a user will know precisely when the seal 145 is properly aligned with the partition aperture 100, since such alignment is accomplished when the elongated stem 115 cannot be raised further.

The connecting portion 142 of the valve 140 includes a connecting groove 144 in which the indented portion 150 of elongated stem 115 fits. However, it should be understood that any conventional method of connecting the elongated stem 115 with the connecting portion 142 of the valve 140 can be utilized.

Figure 12B:
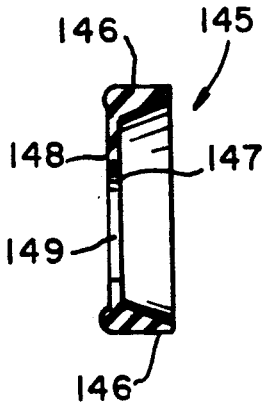
FIG. 12(*a*) and (*b*) are views of a seal according to the present invention.
Figure 12A:
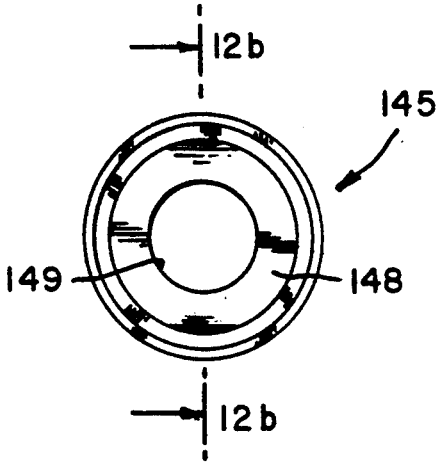

FIGS. 12(*a*) and (*b*) show the seal 145 which fits into the sealing portion 143 of the valve 140. The seal 145 includes a circumferentially defined seal sidewall 146, a seal aperture 149, an inner surface 147 and an outer surface 148. When assembled, as shown in FIG. 1, the outer surface 148 faces towards the partition 90. Thus, in the raised or divert position, when the seal 145 is aligned with the partition aperture 100, water flows through the partition aperture 100 and seal aperture 149, and is blocked by the sealing portion 143 and seal sidewall 146. Thus, water pressure is established against the inner surface 147 of the seal 145 so as to push the outer surface 148 against the partition 90 and block or divert water flow to the outlet 35 end of the hollow spout 20. Further, the raised or divert position will be maintained by the water pressure, and will not be maintained if no water pressure is established, i.e.. if water is not flowing into the hollow spout 20, the raised position will not be maintained. Accordingly, in operation, a user must hold the elongated stem 115 in the raised position until sufficient water pressure is established to maintain and hold the elongated stem 115 and valve 140 in the raised position, wherein the user can then release the elongated stem 115. Further, when the valve 140 is in the lowered or non-divert position, any water in the sealing portion 143 is allowed to escape via the water release groove 141.

In an alternative embodiment, as shown in FIGS. 13–14, a hose 250 with, for example, a shower head 255 attached thereto can be attached to the hollow spout 20. In such an embodiment, a threaded hole 215 is drilled and tapped through one of the bosses 200–204 of the hollow spout 20, and a blind hole 220 is drilled through the valve body 75 at a location which corresponds with the threaded hole 215. Further, the location on the valve body 75 at which the blind hole 215 is drilled through may be "built-up" to form a boss 214 through which a hole 216 would also be drilled.

An outlet connecting pipe 225 includes a first threaded segment 230 for threadedly engaging the threaded hole 215, a grooved segment 235, and a second threaded segment 240. The second threaded segment 240 s compatible with and connects to a connector 226 which is attached to the hose 250. However, it should be appreciated that any conventional means can be utilized to suitably connect the hose 250 to the outlet connecting pipe 225.

An O-ring 245 fits into the grooved segment 235 so that a seal is formed within the blind hole 220 when the outlet connecting pipe 225 is threadedly engaged with the threaded hole 215. Note that the threaded hole 215 can be drilled and tapped through any one of the bosses 200–204, and the blind hole 220 can be drilled through the corresponding location of the valve body 75. FIGS. 4–7 illustrate one location where the blind hole 220 can then be drilled through the valve body 75 and where the valve body 75 is built up to form a boss 214.

Thus, in this alternative embodiment, when the tub spout 5 is in the raised or divert position so as to block water flow to the outlet end 35 of the hollow spout 20, water flowing into the chamber 95 is diverted through the blind hole 220 and flows through the outlet connecting pipe 225 to the hose 250 and shower head 255. Note that the seal formed by the O-ring 240 within the blind hole 220 blocks water from flowing around the outlet connecting pipe 225 and through the blind hole 220 to the hollow spout 20.

While the invention is disclosed and more particularly described with the presently preferred embodiment, it is not intended that the invention be limited to the described embodiment. It will be obvious to those skilled in the art that modifications may be made without departing from the scope and spirit of the invention. Thus, it is intended that the appended claims cover all equivalent variations as may be subsequently contemplated.

What is claimed is:

1. A replaceable diverter device for a tub spout capable of diverting water received from a source pipe, comprising:

a hollow spout having an outlet and inlet with a keyway adjacent a top inner side of said hollow spout;

a two piece inner valve assembly for said diverter device comprising a rear backdoor cap being removably assembled at said inlet and having a rear aperture for allowing water from said source pipe to enter said hollow spout and valve means, locked to said tub spout by said rear cap, and having a water flow chamber, with said valve means being removably disposed in said hollow spout by said rear backdoor cap, for blocking water flow from said rear aperture to said outlet; and control means connected to said valve means for regulating said valve means so as to control the flow of water through said hollow spout;

said valve means including keying means in the form of a flange for aligning with said keyway, thereby enabling said valve means of said two piece inner valve assembly to be precisely located upon assembly and replacement of said diverter device in said tub spout; and sealing means about the inner side of said hollow spout and between said valve means and said rear backdoor cap for precluding any water leakage between said water flow chamber and said rear backdoor cap; whereby replacement of said diverter device is inexpensive and relatively simple.

2. A tub spout according to claim 1, further including threaded portions on said hollow spout and rear cap for connecting said rear cap to said inlet of said hollow spout.

3. A tub according to claim 1, wherein said valve mean comprises:

a valve body being insertable into said hollow spout through said inlet and being removable from said hollow spout through said inlet, said valve body including walls and a partition connected to said walls which form said chamber with said walls and said rear cap, said partition having a partition aperture for allowing water entering said rear aperture to flow from said chamber to said outlet of said hollow spout; and a valve having a seal alignable with said partition aperture for sealing said partition aperture.

4. A tub spout according to claim 3, wherein said valve body comprises plastic.

5. A tub spout according to claim 3, wherein said seal comprises rubber.

6. A tub spout according to claim 3, wherein said control means comprises a spout aperture through said hollow spout and a stem extending through said spout aperture, said stem having a first end for controlling movement of said stem and a second end connected to said valve for controlling movement of said valve by movement of said stem.

7. A tub spout according to claim 3, wherein said seal utilizes water pressure to block water flow to said outlet of said hollow spout.

8. A tub spout according to claim 6, further comprising a guide section connected to said valve means and having a guide aperture in substantial alignment with said spout aperture, said stem being guided by said guide aperture and said spout aperture.

9. A tub spout according to claim 7, wherein said seal includes an inner surface, an outer surface, a seal sidewall, and a seal aperture through which water flows, said valve and seal sidewall blocking water flowing through said seal aperture for creating water pressure against said inner surface for pushing said outer surface against said partition for blocking water flow to said outlet of said hollow spout.

10. A tub spout according to claim 1, further including secondary outlet means for attaching at least a hose to said tub spout for connection to said water flow chamber through which water flows when said valve means blocks water flow from said rear aperture to said outlet.

11. A tub spout according to claim 10, further including a shower head attached to said hose.

12. A replaceable diverter device for a tub spout receiving water from a source pipe having an external threaded segment, and being capable of diverting water received from the source pipe having an external threaded segment, comprising:

a hollow spout comprising an inner side with a threaded portion, a spout aperture, an outlet, and an inlet with a keyway adjacent a top inner side of said hollow spout;

a two piece inner valve assembly for said diverter device comprising a rear backdoor cap having a threaded portion for removably and threadably engaging said hollow spout threaded portion with said rear backdoor cap further having a rear aperture with threads for threadably engaging said external threaded segment of said source pipe for allowing water from said source pipe to enter said hollow spout through said rear aperture, and a valve body insertable into and removable from said hollow spout through said inlet, said valve body including walls and a partition connected to said walls which form a water flow chamber with said walls and said rear backdoor cap, said partition having a partition aperture for allowing water entering said rear aperture to flow from said water flow chamber to said outlet of said hollow spout;

a stem having one end extending into said hollow spout through said spout aperture;

a valve having a seal alignable with said partition aperture for sealing said partition aperture, said valve being connected to one end of said stem for allowing alignment of said seal with said partition aperture to be controlled by said stem;

said valve body including keying means in the form of a flange for aligning with said keyway, thereby enabling said valve body of said two piece inner valve assembly to be precisely located upon assembly and replacement of said diverter device in said tub spout; and sealing means about the inner side of said hollow spout and between said valve body and said rear backdoor cap for precluding any water leakage between said water flow chamber and said rear backdoor cap; whereby replacement of said diverter device is inexpensive and relatively simple.

13. A tub spout according to claim 12 wherein said valve body comprises plastic.

14. A tub spout according to claim 12 wherein said seal comprises rubber.

15. A tub spout according to claim 12 wherein said seal utilizes water pressure to block water flow to said outlet of said hollow spout.

16. A tub spout according to claim 14, wherein said seal includes an inner surface, an outer surface, a seal sidewall, and a seal aperture through which water flows, said valve and seal sidewall blocking water flowing through said seal aperture for creating water pressure against said inner surface for pushing said outer surface against said partition for blocking water flow to said outlet end of said hollow spout.

17. A tub spout according to claim 12, wherein said valve body further includes a guide section having a guide aperture in substantial alignment with said spout aperture.

18. A tub spout according to claim 17, wherein said guide section limits movement of said valve.

19. A tub spout according to claim 12, further including secondary outlet means for attaching at least a hose to said tub spout for connection to said water flow chamber through which water flows when said valve means blocks water flow from said rear aperture to said outlet.

20. A tub spout according to claim 19, further including a shower head attached to said hose.

* * * * *